US009364095B2

(12) United States Patent
Jorgensen et al.

(10) Patent No.: US 9,364,095 B2
(45) Date of Patent: Jun. 14, 2016

(54) SPRING CORE HAVING A FULLY ACTIVE SPRING AND METHOD OF MANUFACTURING THE SAME

(71) Applicant: L&P Swiss Holding AG, Wittenbach (CH)

(72) Inventors: Morten Jorgensen, Gram (DK); Niels Albaek, Varde (DK)

(73) Assignee: L&P Swiss Holding AG, Wittenbach (CH)

( * ) Notice: Subject to any disclaimer, the term of this patent is extended or adjusted under 35 U.S.C. 154(b) by 377 days.

(21) Appl. No.: 13/930,331

(22) Filed: Jun. 28, 2013

(65) Prior Publication Data

US 2014/0026328 A1 Jan. 30, 2014

(30) Foreign Application Priority Data

Jul. 26, 2012 (EP) ..... 12005447

(51) Int. Cl.

| | |
|---|---|
| ***A47C 23/04*** | (2006.01) |
| ***A47C 23/043*** | (2006.01) |
| ***A47C 27/06*** | (2006.01) |

(52) U.S. Cl.

CPC ..... *A47C 23/043* (2013.01); *A47C 27/064* (2013.01); *Y10T 29/481* (2015.01)

(58) Field of Classification Search

CPC .. A47C 23/04; A47C 23/043; A47C 23/0438; A47C 27/064

See application file for complete search history.

(56) References Cited

U.S. PATENT DOCUMENTS

| | | | | |
|---|---|---|---|---|
| 1,950,770 | A * | 3/1934 | Bayer | A47C 27/04 5/248 |
| 1,963,055 | A | 6/1934 | Powers | |
| 3,942,776 | A | 3/1976 | Jenkins et al. | |
| 4,760,616 | A * | 8/1988 | Hiatt | A47C 23/007 267/103 |
| 4,817,924 | A | 4/1989 | Thoenen | |
| 5,040,255 | A | 8/1991 | Barber, Jr. | |
| 5,575,460 | A | 11/1996 | Knopfel | |
| 5,713,088 | A | 2/1998 | Wagner et al. | |
| 5,924,681 | A | 7/1999 | Bullard | |
| 6,186,483 | B1 | 2/2001 | Bullard | |
| 6,256,820 | B1 | 7/2001 | Moser et al. | |
| 6,295,676 | B1 | 10/2001 | Warner | |
| 6,397,418 | B1 | 6/2002 | Stjerna | |

(Continued)

FOREIGN PATENT DOCUMENTS

| | | |
|---|---|---|
| DE | 202008008652 | 11/2009 |
| GB | 2025217 | 1/1980 |

(Continued)

*Primary Examiner* — David E Sosnowski

(74) *Attorney, Agent, or Firm* — Wood, Herron & Evans, LLP

(57) ABSTRACT

A pocket spring core for a bedding or seating cushion comprises an array of pocket springs. The array of pocket springs comprises fully active springs (10) respectively enclosed in an associated pocket (35) of fabric. Each fully active spring (10) respectively has a central spiral portion (20) with at least one turn and defining a spring axis (13), an unknotted first end turn (21) defining a first end of the fully active spring (10), and an unknotted second end turn (22) defining an opposing second end of the fully active spring (10). Each fully active spring (10) has a rest shape in which the first end turn (21) and the second end turn (22) have a finite pitch angle, so that the first end turn (21) and the second end turn (22) contribute to a spring force of the fully active spring (10).

15 Claims, 5 Drawing Sheets

(56) References Cited

U.S. PATENT DOCUMENTS

| | | | | |
|---|---|---|---|---|
| 7,178,187 | B2 * | 2/2007 | Barman | A47C 23/043 267/166.1 |
| 7,210,181 | B1 * | 5/2007 | Price | A47C 23/02 267/162 |
| 7,386,897 | B2 * | 6/2008 | Eigenmann | A47C 23/04 267/103 |
| 7,677,541 | B2 | 3/2010 | Ahn | |
| 7,921,561 | B2 | 4/2011 | Eigenmann et al. | |
| 8,136,187 | B2 | 3/2012 | Mossbeck et al. | |
| D661,925 | S * | 6/2012 | DeFranks | A47C 23/0438 D6/718.31 |
| 8,429,772 | B2 | 4/2013 | Eigenmann et al. | |
| 8,720,872 | B2 * | 5/2014 | DeMoss | A47C 23/04 267/103 |
| D739,162 | S * | 9/2015 | Jorgensen | A47C 27/065 D6/606 |
| 2006/0042016 | A1 | 3/2006 | Barman et al. | |
| 2006/0277686 | A1 * | 12/2006 | Eigenmann | A47C 23/04 5/716 |
| 2009/0106908 | A1 * | 4/2009 | DeFranks | A47C 23/0438 5/716 |
| 2010/0295223 | A1 * | 11/2010 | Eigenmann | A47C 23/04 267/166 |
| 2011/0148018 | A1 * | 6/2011 | DeFranks | A47C 23/0438 267/166.1 |
| 2012/0112396 | A1 | 5/2012 | DeFranks et al. | |
| 2013/0192003 | A1 * | 8/2013 | DeMoss | A47C 23/04 5/716 |
| 2014/0026328 | A1 * | 1/2014 | Jorgensen | A47C 27/064 5/720 |
| 2015/0084250 | A1 * | 3/2015 | Ahn | A47C 27/065 267/142 |

FOREIGN PATENT DOCUMENTS

| | | |
|---|---|---|
| KR | 100988455 | 10/2010 |
| NZ | 505101 | 3/2002 |

* cited by examiner

SPRING CORE HAVING A FULLY ACTIVE SPRING AND METHOD OF MANUFACTURING THE SAME

FIELD OF THE INVENTION

The invention relates to a method of manufacturing a spring core, to a spring core having a fully active spring and to a fully active spring for use in spring cores. The invention relates in particular to pocket spring cores having a plurality of springs respectively enclosed in a pocket of fabric.

BACKGROUND

Spring cores are widely used in seating or bedding products. Such spring cores commonly are made from a matrix of multiple springs joined together directly as by helical lacing wires, or indirectly as by fabric within which each individual spring is contained. Pocket spring cores in which springs are respectively contained in a pocket of fabric are popular, due to the comfort and luxury feel provided by pocket spring cores.

In order to provide firm support, it is desirable to use springs having a high firmness. This can be attained by preloading springs. U.S. Pat. No. 6,186,483 B1 and U.S. Pat. No. 5,924,681 B1 respectively describe springs having knotted end turns, in which the spring is preloaded using a loop of fabric.

U.S. Pat. No. 4,817,924 describes a spring core for a mattress in which springs have unknotted end turns. The end turns include portions which essentially extend perpendicular to a longitudinal axis of the spring. Other examples for coil springs having unknotted end turns are described in US 2010/0295223 A1 and U.S. Pat. No. 7,921,561 B1, for example. The flat surface defined by the end turns of the springs, even in the rest state of the springs in which the springs are unloaded, assists in providing a flat support surface, which is desirable in terms of comfort.

Springs for use in pocket spring cores have traditionally been designed so as to define an end surface oriented normal to the spring axis in the rest state of the spring. Frequently, the end turns are knotted. By using springs having end turns with ring-like portions oriented perpendicular to the longitudinal axis of the spring, flat surfaces may be defined at the upper and lower ends of the spring. Such ring-like support surfaces assist in providing the pocket spring core with comparatively flat upper and lower surfaces. Further, problems associated with wear of the pocket material may be mitigated.

While high comfort and luxury feel can be attained by using springs that have flat end turns oriented normal to the spring axis, the flat end turns do not contribute to the firmness of the spring. Thus, such spring configurations may require a greater amount of wire. To provide greater firmness while reducing the overall wire length, a more aggressive pitch could be used on the central portion of the spring. However, in order for the spring to retain its shape memory, there are bounds for the pitch which can be used. The greater amount of wire required for producing the springs used in conventional pocket spring cores increases the costs of such spring cores.

SUMMARY

There is a continued need in the art for a spring core and method of manufacturing the same and for a spring which address some of the above needs. In particular, there is a continued need for such products and methods which allow manufacturing costs associated with pocket spring cores to be kept more moderate. There is a need for such products and methods in which a smaller amount of wire is required to form the springs which are inserted into the pockets, while providing a firmness which is at least comparable to that of conventional pocket springs.

According to an embodiment, a method of manufacturing a pocket spring core for a bedding or seating cushion is provided. A plurality of springs is provided. Each spring of the plurality of springs is enclosed in respectively an associated pocket to form a string of pocket springs. The plurality of springs comprises fully active springs. Each fully active spring respectively has a central spiral portion with at least one turn, an unknotted first end turn, and an unknotted second end turn, the first end turn defining a first end of the fully active spring and the second end turn defining an opposing second end of the fully active spring. The central spiral portion defines a spring axis. Each fully active spring is configured such that, in an uncompressed state and when the fully active spring is not enclosed in the associated pocket, the first end turn and the second end turn have a finite, i.e. non-zero, pitch angle, so that the first end turn and the second end turn contribute to a spring force of the fully active spring.

In the method, at least some of the springs used to form a pocket spring core are fully active springs. In the fully active springs, the end turns which define opposing axial ends of the fully active spring are provided with a finite, i.e. non-zero, pitch angle. The rest shape of each fully active spring is such that the end turns of the fully active springs do not define flat rings extending in a plane perpendicular to the spring axis, but contribute to the spring force. This allows the amount of wire required to attain a given firmness to be reduced.

The rest shape of each fully active spring may be such that, in the uncompressed state of the fully active spring and when the fully active spring is not enclosed in the associated pocket, the fully active spring has a finite pitch angle throughout the first end turn and throughout the second end turn.

The rest shape of each fully active spring may be such that, in the uncompressed state of the fully active spring and when the fully active spring is not enclosed in the associated pocket, the first end turn has a pitch angle of at least 8° at any location on the first end turn within 35 mm from an upper spring end. Alternatively or additionally, the rest shape of each fully active spring may be such that, in the uncompressed state of the fully active spring and when the fully active spring is not enclosed in the associated pocket, the second end turn has a pitch angle of at least 8° at any location on the second end turn within 35 mm from a lower spring end. The upper and lower spring ends may be taken to be the outermost points of the spring in its rest shape along the direction defined by the spring axis. The distance of 35 mm may be measured along the spring wire.

Each fully active spring and the associated pocket may be dimensioned such that, when the fully active spring is enclosed in the associated pocket, the first and second end turns are compressed such that the compressed first end turn lies in a first plane arranged at an angle different from 90° relative to the spring axis and the compressed second end turn lies in a second plane arranged at an angle different from 90° relative to the spring axis.

Each fully active spring may further include a first end extension which extends from the first end turn and bends toward the central spiral portion. Each fully active spring may further include a second end extension which extends from the second end turn and bends toward the central spiral portion. Problems associated with wear of the pocket material may thereby be mitigated. The first end extension and the second end extension may respectively have a length of 10 to 20 mm, measured along the wire of the end extensions.

The central spiral portion of each fully active spring may comprise at least one turn. The central spiral portion of each fully active spring may comprise at least two turns. Each fully active spring may have at least four turns, including the first and second end turns.

Each fully active spring may have a wire gauge selected from an interval from at least 0.8 mm to at most 2.2 mm. Each fully active spring may have a wire gauge selected from an interval from at least 1.6 mm to at most 2.2 mm.

The central spiral portion of each fully active spring may have a diameter selected from an interval from at least 25 mm to at most 90 mm. The central spiral portion of each fully active spring may have a diameter selected from an interval from at least 60 mm to at most 80 mm.

The method may comprise performing an ultrasonic welding operation to form longitudinal and transverse seems of the pockets.

The method may comprise attaching plural strings of pocket springs to each other to form a pocket spring core.

The method may be such that each spring used in the pocket spring core is a fully active spring.

The fabric from which the pockets are formed may be a nonwoven fabric.

The method may comprise compressing the springs of the pocket spring core in a direction parallel to the spring axis to compress the pocket spring core, and winding up the compressed pocket spring core about an axis which is transverse to the spring axes of all pocketed springs. The pocket spring core may thereby be brought into a roll-shape with compact dimensions, which is particularly suitable for shipping.

The method may comprise forming the fully active springs using a coiler. The method may comprise heat-treating the fully active springs prior to inserting them into the associated pockets of fabric.

According to another embodiment, a pocket spring core for a bedding or seating cushion is provided. The pocket spring core comprises an array of pocket springs, the array of pocket springs comprising fully active springs respectively enclosed in an associated pocket of fabric. Each fully active spring respectively has a central spiral portion with at least one turn and defining a spring axis, an unknotted first end turn defining a first end of the fully active spring, and an unknotted second end turn defining an opposing second end of the fully active spring. Each fully active spring has a rest shape in which the first end turn and the second end turn have a finite, i.e. non-zero, pitch angle, so that the first end turn and the second end turn contribute to a spring force of the fully active spring.

The rest shape of each fully active spring may be such that the first end turn has a pitch angle of at least 8° at any location on the first end turn within 35 mm from an upper spring end. The rest shape of each fully active spring may be such the second end turn has a pitch angle of at least 8° at any location on the second end turn within 35 mm from a lower spring end.

Each fully active spring and the associated pocket may be dimensioned such that, when the fully active spring is enclosed in its associated pocket, the first end turn is compressed such that the compressed first end turn lies in a first plane arranged at an angle different from 90° relative to the spring axis. Each fully active spring and the associated pocket may be dimensioned such that, when the fully active spring is enclosed in its associated pocket, the second end turn is compressed such that the compressed second end turn lies in a second plane at an angle different from 90° relative to the spring axis.

Each fully active spring may further include a first end extension which extends from the first end turn and bends toward the central spiral portion. Each fully active spring may further include a second end extension which extends from the second end turn and bends toward the central spiral portion. Problems associated with wear of the pocket material may thereby be mitigated.

The central spiral portion of each fully active spring may comprise at least one turn. The central spiral portion of each fully active spring may comprise at least two turns. Each fully active spring may have at least four turns, including the first and second end turns.

Each fully active spring may have a wire gauge selected from an interval from at least 0.8 mm to at most 2.2 mm. Each fully active spring may have a wire gauge selected from an interval from at least 1.6 mm to at most 2.2 mm.

The central spiral portion of each fully active spring may have a diameter selected from an interval from at least 25 mm to at most 90 mm. The central spiral portion of each fully active spring may have a diameter selected from an interval from at least 60 mm to at most 80 mm.

The pockets may be formed from a nonwoven fabric.

According to another embodiment, a fully active spring for a pocket spring core for a bedding or seating cushion is provided. The fully active spring has a central spiral portion with at least one turn, an unknotted first end turn defining a first end of the fully active spring, and an unknotted second end turn defining a second end of the fully active spring arranged opposite to the first end. The fully active spring has a rest shape in which the first end turn and the second end turn have a finite, i.e. non-zero, pitch angle, so that the first end turn and the second end turn contribute to a spring force of the fully active spring.

The rest shape of the fully active spring may be such that the first end turn has a pitch angle of at least 8° at any location on the first end turn within 35 mm from an upper spring end. The rest shape of the fully active spring may be such the second end turn has a pitch angle of at least 8° at any location on the second end turn within 35 mm from a lower spring end.

The fully active spring may further include a first end extension which extends from the first end turn and bends toward the central spiral portion. The fully active spring may further include a second end extension which extends from the second end turn and bends toward the central spiral portion. Problems associated with wear of the pocket material may thereby be mitigated.

The central spiral portion of the fully active spring may comprise at least one turn. The central spiral portion of the fully active spring may comprise at least two turns. The fully active spring may have at least four turns, including the first and second end turns.

The fully active spring may have a wire gauge selected from an interval from at least 0.8 mm to at most 2.2 mm. The fully active spring may have a wire gauge selected from an interval from at least 1.6 mm to at most 2.2 mm.

The central spiral portion of the fully active spring may have a diameter selected from an interval from at least 25 mm to at most 90 mm. The central spiral portion of the fully active spring may have a diameter selected from an interval from at least 60 mm to at most 80 mm.

Modifications and additional features of the pocket spring core and of the fully active spring according to embodiments correspond to modifications and additional features set forth in the context of the method of forming the pocket spring core.

According to embodiments, a pocket spring core is formed which includes fully active springs, in which first and second end turns at opposing ends of the spring are not configured as a flat ring extending normal to the spring axis, but have a finite tilt angle. The first and second end turns contribute to the spring force. The amount of wire required to provide adequate spring force may be reduced.

BRIEF DESCRIPTION OF THE DRAWINGS

Embodiments of the invention will be described with reference to the accompanying drawings.

DETAILED DESCRIPTION OF EMBODIMENTS

Figure 1:
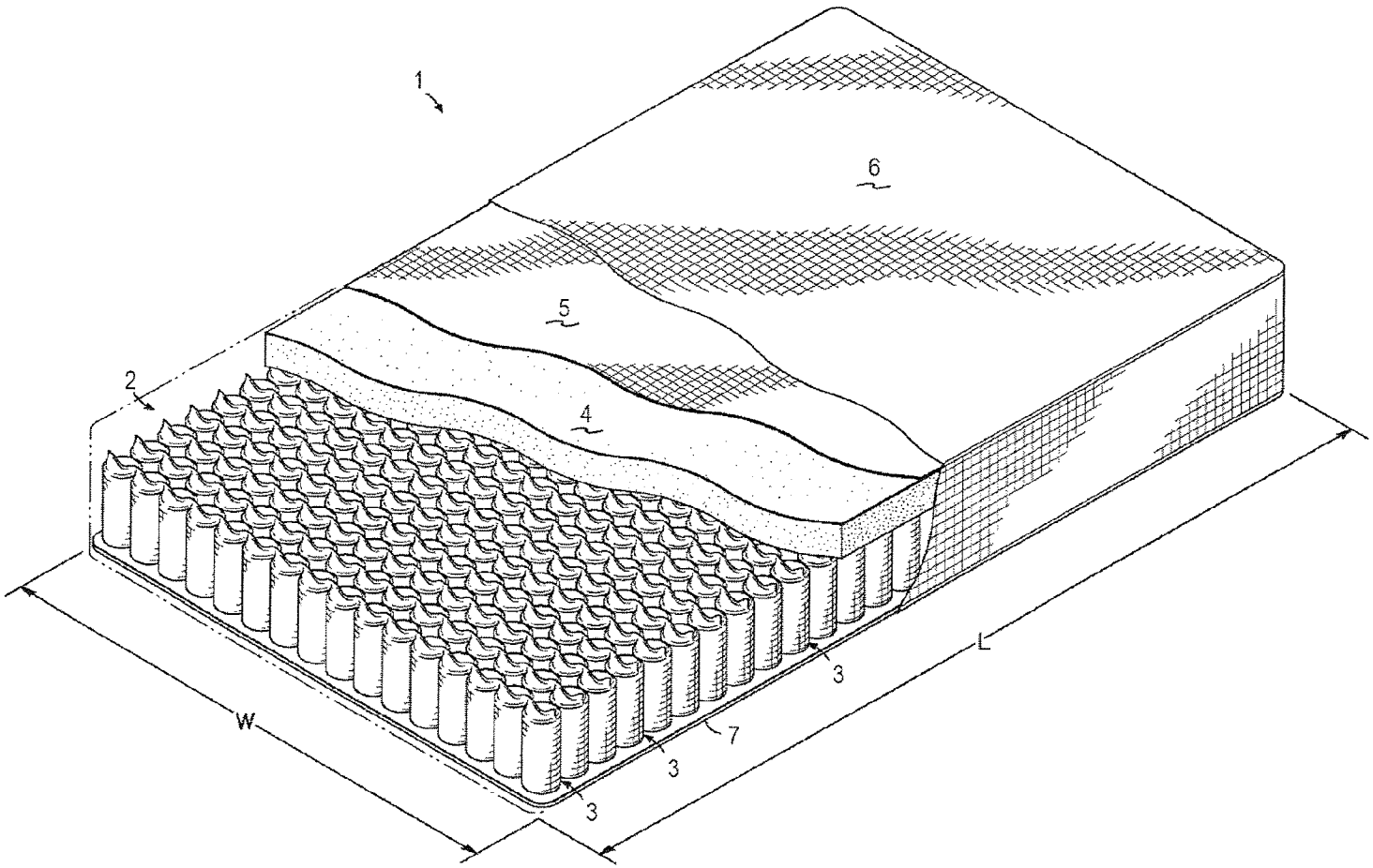
FIG. 1 is a perspective view, partially broken away, of a cushion including a pocket spring core of an embodiment.

Exemplary embodiments of the invention will be described with reference to the drawings. While some embodiments will be described in the context of specific fields of application, such as in the context mattresses, the embodiments are not limited to this field of application. The features of the various embodiments may be combined with each other unless specifically stated otherwise. Throughout the following description, same or like reference numerals refer to same or like components or mechanisms.

FIG. 1 shows a cushion in the form of a single-sided mattress 1 incorporating a pocket spring core 2 according to an embodiment. This cushion or mattress 1 comprises the pocket spring core 2 over the top of which there is a foam pad 4 covered by a fiber pad 5. This complete assembly is mounted upon a base 7 and is completely enclosed within an upholstered covering material 6. While one embodiment of the invention described herein is illustrated and described as being embodied in a single-sided mattress, it is equally applicable to double-sided mattresses or seating cushions. In the event that it is utilized in connection with a double-sided mattress, the bottom side of the spring core may have a foam pad applied over the bottom side of the spring core and that pad is in turn covered by a fiber pad of cushioning material.

The pocket spring core 2 is manufactured from multiple strings 3 of pocket springs. A string 3 of pocket springs may respectively be formed by providing a fabric layer, inserting a fully active spring into the fabric layer, folding the fabric layer so as to cover the fully active spring either before or after insertion of the fully active spring, and applying longitudinal and transverse seams, e.g. by welding. Each string 3 of pocket springs may extend across the full width of the product 1. These strings are connected in side-by-side relationship as, for example, by gluing the sides of the strings 3 together in an assembly machine, so as to create an assembly or matrix of springs having multiple rows and columns of pocketed springs bound together as by gluing, welding or any other conventional assembly process commonly used to create pocket spring cores. The pocket spring core 2 may be made upon any conventional pocket spring manufacturing machine and by any conventional pocketing spring process, as long as at least some of the springs enclosed in an associated pocket are fully active springs, as will be explained in more detail hereinafter.

At least some of the springs enclosed in pockets of the pocket spring core 2 are fully active springs. Generally, a fully active spring is defined to be a spring which has a rest shape in which first and second end turns defining opposite axial ends of the fully active spring respectively have a finite, i.e. non-zero, pitch angle, so as to contribute to the spring force of the fully active spring upon compression. The first end turn of the fully active spring does not have a portion which extends perpendicularly to the spring axis throughout a significant fraction of a turn. Similarly, the second end turn of the fully active spring does not have a portion which extends perpendicularly to the spring axis throughout a significant fraction of a turn. On each one of the first and second end turns, the spring may have a pitch angle greater than a threshold, e.g. greater than 5° or 8°, throughout a length which extends from an axially outermost point of the spring towards a central portion of the spring.

With reference to FIGS. 2 to 8, features of fully active springs according to embodiments will be described. The fully active springs have shape memory. This may be attained by suitable choice of material and suitable treatment of the springs, e.g. by heat-treatment. Geometrical features of the rest shape of the fully active springs described herein are therefore the same irrespective of whether the spring is in an unloaded state before it is inserted into the respective pocket or whether it is in an unloaded state after it is removed again from its associated pocket. Due to the shape memory, geometrical features of the rest shape of the fully active springs define the fully active springs even when the fully active springs are deformed to have a different configuration, e.g. while they are arranged in and preloaded by an associated pocket of fabric.

Figure 2:
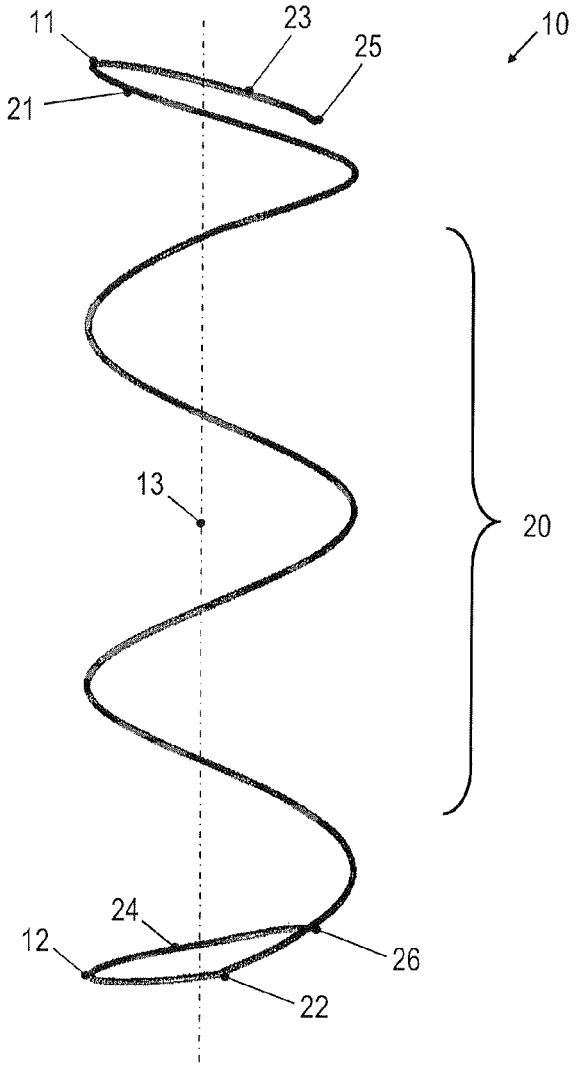
FIG. 2 shows a fully active spring which may be used in methods and pocket spring cores of an embodiment, before the spring is enclosed in an associated pocket.

FIG. 2 shows a fully active spring 10 which may be used in at least some or in all pockets of the pocket spring core. FIG. 2 shows the fully active spring 10 in an unloaded state in which it is not inserted into and not enclosed by the associated pocket of fabric.

The fully active spring 10 has unknotted end turns. There are free wire ends 25, 26 which remain unknotted, even when the fully active spring 10 is inserted into the associated pocket of fabric. The end turns of the fully active spring 10 are tilted relative to a spring axis 13. The rest shape of the fully active spring 10 is such that the end turns do not have larger portions that extend in a plane perpendicular to the spring axis 13, as is the case for conventional springs for pocket spring cores. When used in a pocket spring core, the fully active spring is preloaded and kept in the preloaded position by the pocket in which the fully active spring is enclosed, as will be described more fully hereinafter.

Generally, the fully active spring 10 has a central spiral portion 20, a first end turn 21 and a second end turn 22. The central spiral portion 20 has at least one turn and may have at least two turns. Overall, the fully active spring 10 may have about four turns, for example, including the end turns 21, 22. The first end turn 21 and the second end turn 22 are provided on opposite sides of the central spiral portion 20 and define opposite ends of the fully active spring 10. A first end extension 23 may extend from the first end turn 21 and may bend back towards the central spiral portion 20. The first end extension 23 may extend from a upper axial end 11 of the fully active spring 10, which is an outermost point of the fully active spring 10 in a direction along the spring axis 13. A second end extension 24 may extend from the second end turn 22 and may bend back towards the central spiral portion 20. The second end extension 24 may extend from a lower axial end 12 of the fully active spring 10, which is the other outermost point of the fully active spring 10 in the direction along the spring axis 13.

The first end turn 21 and the second end turn 22 of the fully active spring 10 are tilted relative to the spring axis 13. As will be explained in more detail below, the end turns 21, 22 of the fully active spring are compressed when the fully active spring 10 is enclosed in its associated pocket of fabric. The first end turn 21 and the second end turn 22 contribute to the spring force of the fully active spring 10, due to the inclination of the first end turn 21 and the inclination of the second end turn 22. The first end turn 21 and the second end turn 22 and the associated first and second end extensions 23, 24 may, but do not need to have a shape in which they essentially extend in planes that are arranged at an angle different from 90° relative to the spring axis 13 when the fully active spring 10 is in an unloaded state, i.e. when the fully active spring 10 has its rest shape.

The first end turn 21 and the second end turn 22 of the fully active spring 10 may be arranged such that, in a side view as shown in FIG. 2, the first and second end turns 21, 22 are not parallel to each other, but have tangent planes which converge towards each other. In a side view as shown in FIG. 2, one of the first and second end turns 21, 22 may be inclined downward and the other one of the first and second end turns 21, 22 may be inclined upward.

The fully active spring 10 may have a wire gauge greater than or equal to 0.8 mm and less than or equal to 2.2 mm. The fully active spring 10 may optionally have a wire gauge which greater than or equal to 1.6 mm and less than or equal to 2.2 mm.

Each turn of the central spiral portion 20 of the fully active spring 10 may have a diameter which is at least 25 mm and at most 90 mm. Each turn of the central spiral portion 20 of the fully active spring 10 may optionally have a diameter which is at least 60 mm and at most 80 mm.

On each of the first and second end turns 21, 22, the spring may have a finite pitch angle throughout at least a certain length. For illustration, on each of the first and second end turns 21, 22, the pitch angle may be at least 8° for a predefined length along the spring from the respective upper and lower spring ends 11, 12 towards the central spring portion 20.

The first end turn 21 may have a pitch angle of at least 8° at any location on the first end turn within 35 mm, measured along the spring wire, from the upper spring end 11 towards the central spring portion 20. The second end turn 22 may have a pitch angle of at least 8° at any location on the second end turn within 35 mm, measured along the spring wire, from the lower spring end 12 towards the central spring portion 20.

In other embodiments, the first end turn 21 may have a pitch angle of at least 5° at any location on the first end turn within a pre-defined distance, measured along the spring wire, from the upper spring end 11 towards the central spring portion 20. The second end turn 22 may have a pitch angle of at least 5° at any location on the second end turn within a pre-defined distance, measured along the spring wire, from the lower spring end 12 towards the central spring portion 20.

The first end extension 23 and the second end extension 25 may respectively have a length of 10 to 20 mm, measured along the wire of the end extension 23 and 25, respectively.

Figure 3:
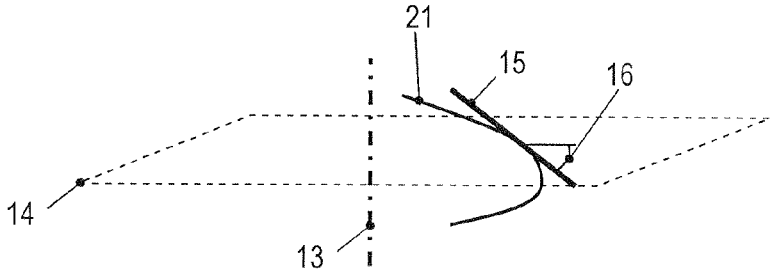
FIG. 3 is a detail view of a portion of an end turn of the fully active spring of FIG. 2.

FIG. 3 shows a detail view of an end turn 21 of the fully active spring for further illustration of the inclined configuration of the end turn. A tangent 15 may be defined for any point on the end turn 21 which is located within a pre-defined distance from the upper spring end 11. The tangent 15 intersects a plane 14 which is perpendicular to the spring axis 13. The tangent 15 is oriented at an angle 16 relative to the plane 14. The angle 16 may define a pitch angle of the end turn 21 at the respective point on the end turn 21. The angle 16 may be at least 8° at any location on the first end turn 21 within 35 mm, measured along the spring wire, from the upper spring end 11 towards the central spring portion 20.

A spring having the configuration described with reference to FIGS. 2 and 3 has been found to provide good support and firmness. The spring of an embodiment reduces the amount of wire compared to conventional pocket springs which, when in an unloaded condition, have end turns with horizontal sections that do not contribute to the spring force.

Each fully active spring 10 used in the pocket spring core 1 and its associated pocket may be dimensioned such that the end turns of the fully active spring 10 are compressed by the pocket of fabric when the fully active spring is enclosed in the associated pocket. The first end turn 21 and the second end turn 22 may be compressed flat by the pocket material. The first end turn 21 and the second end turn 22 may be compressed by the pocket such that, in the state in which the fully active spring is enclosed in its associated pocket, at least a portion of the compressed first end turn defines an upper end of the pocketed fully active spring and the compressed first end turn defines a first plane which is arranged at an angle different from 90° to the spring axis 13. Similarly, the second end turn 22 may be compressed such that, in the state in which the fully active spring is enclosed in its associated pocket, at least a portion of the compressed second end turn defines a lower end of the pocketed fully active spring and the compressed second end turn defines a second plane which is arranged at an angle different from 90° to the spring axis 13. The first and second planes may be angled relative to each other.

Figure 4:
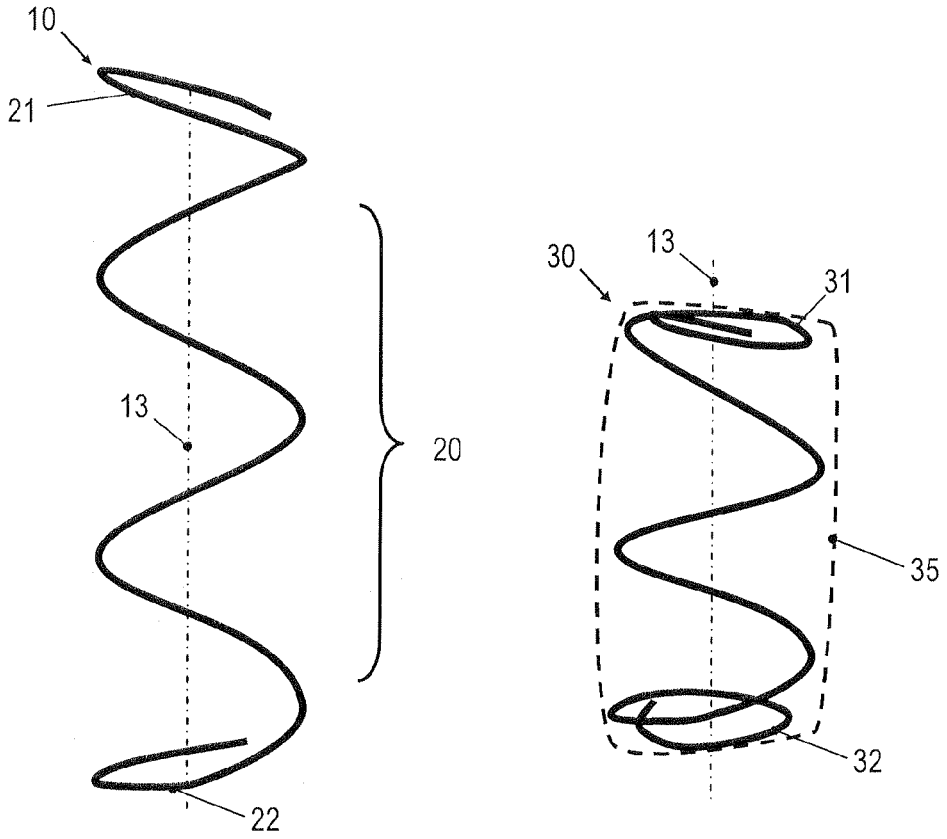
FIG. 4 shows a rest shape of the fully active spring of FIG. 2 and a preloaded state in which the fully active spring is enclosed in its associated pocket.

FIG. 4 illustrates the compression of the first and second end turns 21, 22 when the fully active spring 10 is enclosed in its associated pocket 35 of fabric. The pocketed fully active spring 30 has an axial length which is smaller than that of the rest shape of the fully active spring 10. The shape memory of the fully active spring ensures that the pocketed fully active spring 30 would resume its rest shape illustrated on the left-hand side of FIG. 4 when removed from the pocket 35.

When the fully active spring is enclosed in its associated pocket 35, the first end turn 21 is compressed by the pocket 35 to form a compressed first end turn 31 of the pocketed fully active spring 30. The second end turn 22 is compressed by the pocket 35 to form a compressed second end turn 32 of the pocketed fully active spring 30. The compressed first end turn 31 and the compressed second end turn 32 may be essentially flat, while not necessarily arranged perpendicularly to the spring axis 13. The first end extension 31 and the second end extension 32 may be arranged so as to be offset from the compressed first end turn 31 and the compressed second end turn 32. The first end extension 31 and the second end extension 32 may be arranged so as to be located in the space defined between the compressed first end turn 31 and the compressed second end turn 32. This allows problems associated with wear of the pocket material to be mitigated.

Figure 5:
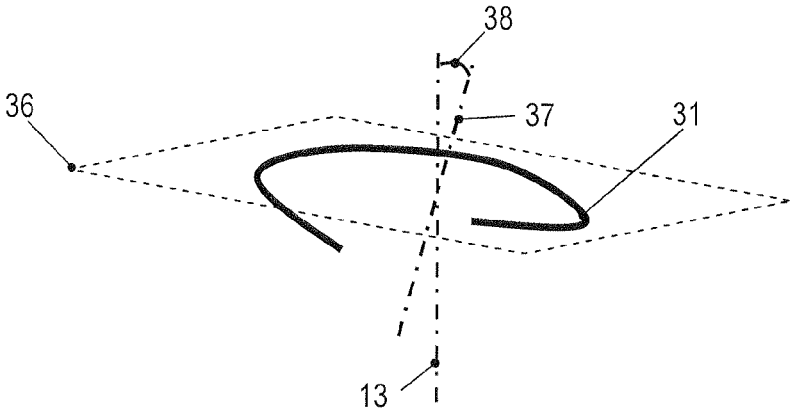
FIG. 5 is a detail view of a portion of an end turn of the fully active spring of FIG. 2 in the preloaded state in which the fully active spring is enclosed in its associated pocket.

FIG. 5 illustrates a detail view of the compressed first end turn 31 of a fully active spring when the fully active spring is enclosed in its associated pocket. The compressed first end turn 31 defines an upper end of the pocketed fully active spring. The compressed first end turn 31 defines a first plane 36 which is arranged at an angle different from 90° to the spring axis 13. I.e., a normal 37 to the first plane 36 is oriented at an angle 38 greater than zero relative to the spring axis 13. The angle 38 may be made small to reduce bumpiness of the upper surface of the spring core.

While a configuration in which the compressed first and second end turns 31, 33 are not oriented completely horizontally when the pocket spring core is installed in a product may give rise to a small degree of bumpiness in the upper and lower surfaces of the pocket spring core, such bumpiness may at least partially be compensated by suitable padding material. The tilted configuration of the first and second planes defined by the compressed first and second end turns, respectively, may be acceptable in view of the overall reduction in wire material needed when fully active springs of embodiments are used.

The finite pitch angle of the first end turn and the finite pitch angle of the second end turn have the effect that the end turns contribute to the spring force. The end extensions 23, 25 do generally not contribute to the spring force, which is acceptable due to their small length.

Figure 6:
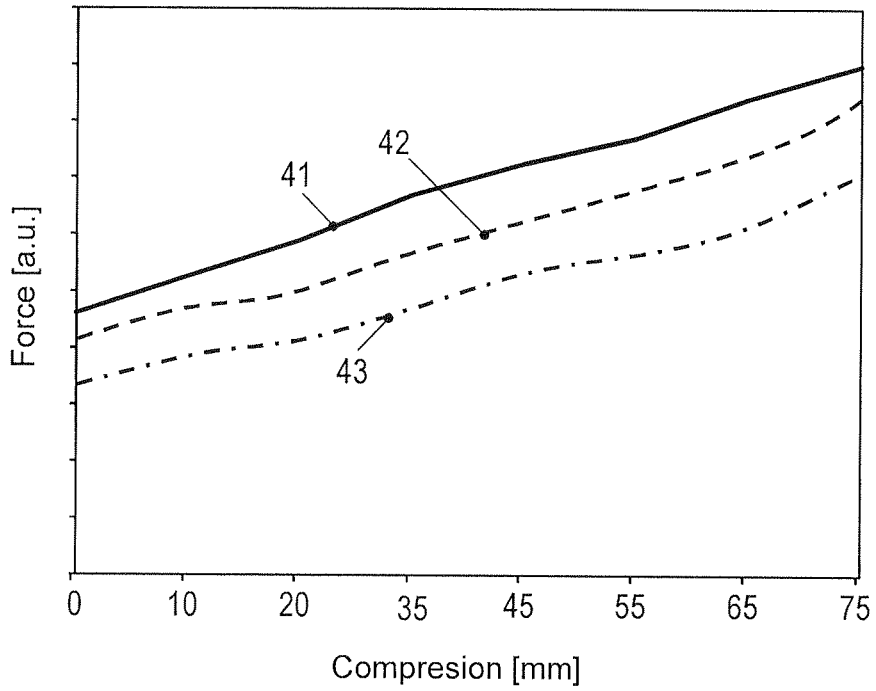
FIG. 6 is a firmness graph showing the firmness of the fully active spring of FIG. 2 in comparison with conventional pocket springs.

FIG. 6 illustrates the firmness for a pocketed fully active spring at curve 41 compared to conventional commercial springs having horizontal end turns at curves 42, 43. FIG. 6 shows the deflection-force curves for these springs. The curve 41 has been obtained for a fully active spring which has a rest shape, before being inserted into an associated pocket, in which the opposite first and second end turns have a finite pitch angle. The other curves 42, 43 have been obtained for springs in which the spring turns end in a flat, horizontal way. Curve 43 shows a normal spring without increased pretension and curve 42 shows a spring having increased pretension.

While configurations of fully active springs which have a generally cylindrical configuration (fully active cylindrical coil springs) are illustrated in FIGS. 2 to 5, the concepts described herein are equally applicable to a wide variety of other spring configurations, such as hourglass-shaped coil springs or barrel shaped coil springs. In particular, the turns of the central portion of the fully active spring may have a diameter which varies as a function of position along the spring axis. The fully active springs may respectively have unknotted end turns which define opposite ends of the fully active spring. The opposite end turns may have a finite pitch angle, and may not have any sections which extend in a plane normal to the spring axis throughout a significant fraction of a turn.

Figure 7:
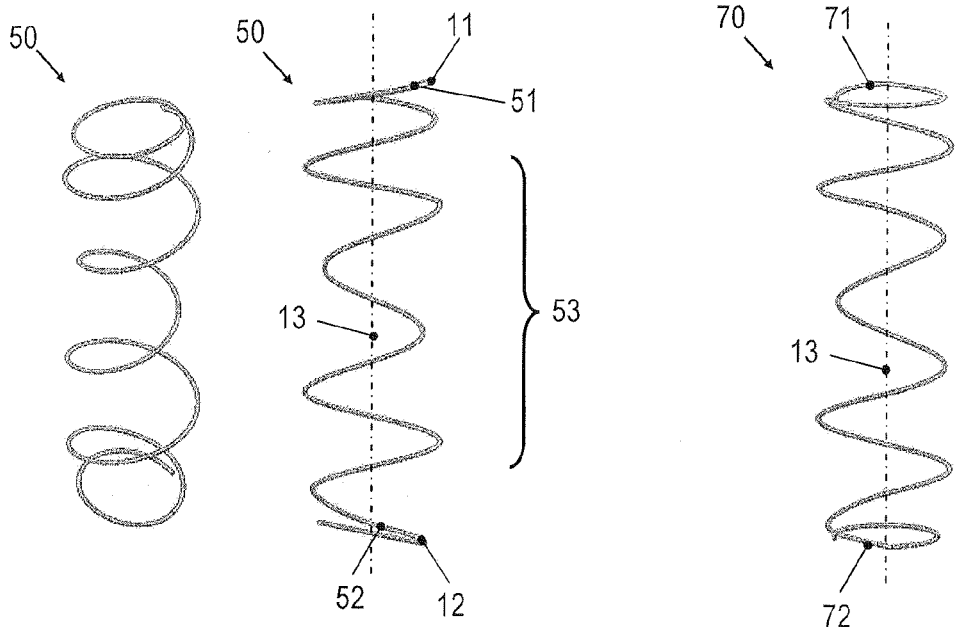
FIG. 7 shows perspective views of a fully active spring which may be used in methods and pocket spring cores of other embodiments, together with a perspective view of a conventional spring.

FIG. 7 shows a fully active spring 50 which is configured as a fully active hourglass-shaped spring. FIG. 7 shows the fully active spring 50 in an unloaded state, i.e. when the fully active spring 50 has its rest shape. The fully active spring 50 has a central portion 53 which defines a spring axis 13. The diameter of the turns of the central portion varies and is minimum at the axial center of the fully active spring 50. Thereby, an hourglass-shape is formed.

A first end turn 51 which defines a first end of the fully active spring 50 and a second end turn 52 which defines an opposite second end of the fully active spring 50 have a finite pitch angle.

For further illustration of the design of end turns 51, 52 having a finite pitch angle, a conventional hourglass spring 70 having unknotted end turns 71, 72 is shown for comparison. The conventional spring 70 has end turns 71, 72 which define the opposing ends of the conventional spring 70. However, the end turns 71, 72 define rings which are located in planes that extend perpendicular to the spring axis. The end turns 71, 72 do not contribute to the spring force of the spring 70.

Figure 8:
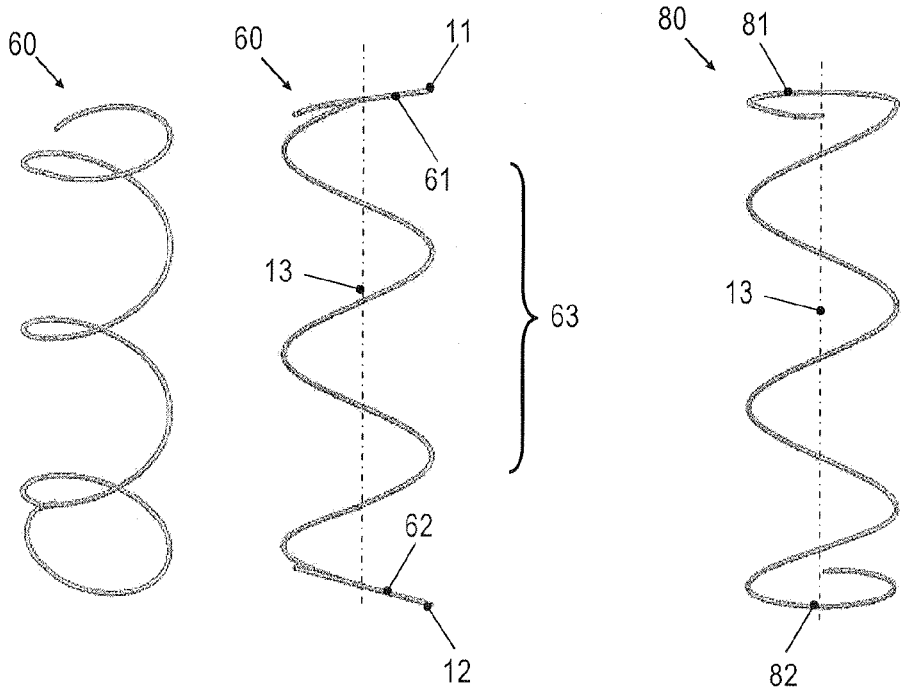
FIG. 8 shows perspective views of a fully active spring which may be used in methods and pocket spring cores of yet other embodiments, together with a perspective view of a conventional spring.

FIG. 8 shows a fully active spring 60 which is configured as a fully active cylindrical spring. FIG. 8 shows the fully active spring 60 in an unloaded state, i.e. when the fully active spring 60 has its rest shape. The fully active spring 60 has a central portion 63 which defines a spring axis 13. The diameter of the turns of the central portion is constant, thereby forming a cylindrical spring.

A first end turn 61 which defines a first end of the fully active spring 60 and a second end turn 62 which defines an opposite second end of the fully active spring 60 have a finite pitch angle.

For further illustration of the design of end turns 61, 62 having a finite pitch angle, a conventional cylindrical spring 80 having unknotted end turns 81, 82 is shown for comparison. The conventional spring 80 has end turns 81, 82 which define the opposing ends of the conventional spring 80. However, the end turns 81, 82 define rings which are located in planes that extend perpendicular to the spring axis. The end turns 81, 82 do not contribute to the spring force of the spring 80, in contrast to the end turns 61, 62 of a fully active spring of an embodiment.

Other features, characteristics and modifications of the fully active springs 50 and 60 of FIGS. 7 and 8 may be the same as any one of those explained with reference to FIGS. 1 to 6. In particular, the wire gauge, the diameter of the turns, the number of turns and/or the pitch angle on the first and second end turns may have any one of the configurations explained with reference to FIGS. 1 to 6.

In the pocket spring core of any one of the embodiments described herein, the fabric from which the pockets are formed may be semi-impermeable. The fabric may be configured such that it has a greater resistance to air flow directed from an exterior to an interior of the pocket than to air flow directed from an interior to an exterior of the pocket. The seams which delimit the respective pockets may be sinusoidal welded seams. These configurations may suitably used in connection with the high firmness, fully active springs of embodiments to provide high firmness when the pocket spring core is loaded.

When manufacturing a pocket spring core, the fully active springs may undergo various processing steps which enhance the shape memory and/or which make it easier to store and ship the pocket spring core. For illustration, the fully active springs may be subjected to heat treatment so as to enhance shape memory. For further illustration, the pocket spring core may be compressed flat and may be wound to form a roll-shaped pocket spring core, which may be convenient for storing and/or shipping.

Fully active pocket springs, pocket spring cores including the same and methods of manufacturing such pocket spring cores have been described in detail. Other configurations may be implemented in other embodiments. For illustration, a wide variety of other configurations of fully active springs may be used, in which unknotted first and second end turns have a finite pitch angle. For illustration, barrel-shaped springs may be used in which turns of the central portion have a diameter varying along the spring axis, with the diameter being maximum at the axial center of the spring.

For further illustration, all pocketed springs of a pocket spring core may be fully active springs having unknotted first and second end turns which are inclined so as to contribute to the spring force of the fully active spring. However, in other implementations, a pocket spring core of an embodiment may include fully active springs having a configuration as described above in some of the pockets and may further include conventional springs arranged in other pockets of the pocket spring core.

While exemplary embodiments have been described in the context of pocket spring cores for mattresses, the fully active springs and pocket spring cores using the fully active springs are not limited to this particular field of application. Rather, embodiments of the invention may be advantageously employed for pocket spring cores for any kind of seating or bedding furniture.

The invention claimed is:

1. A method of manufacturing a pocket spring core for a bedding or seating cushion, said method comprising:

providing a plurality of springs, each spring being made of a single piece of wire, and enclosing each spring of said plurality of springs in respectively an associated pocket to form a string of pocket springs, wherein said plurality of springs comprises fully active springs, each fully active spring respectively having a central spiral portion with at least one turn, an unknotted first end turn, and an unknotted second end turn, the first end turn defining a first end of the fully active spring and the second end turn defining an opposing second end of the fully active spring, wherein said central spiral portion defines a spring axis, and wherein each fully active spring is configured such that, in an uncompressed state and when the fully active spring is not enclosed in the associated pocket, the first end turn and the second end turn have a finite pitch angle which is greater than the pitch angle when the fully active spring is enclosed in the associated pocket, so that the first end turn and the second end turn contribute to a spring force of the fully active spring.

2. The method of claim 1, wherein, for each fully active spring, in the uncompressed state of the fully active spring and when the fully active spring is not enclosed in the associated pocket, the first end turn has a pitch angle of at least 8° at any location on the first end turn within 35 mm from an upper spring end, and the second end turn has a pitch angle of at least 8° at any location on the second end turn within 35 mm from a lower spring end.

3. The method of claim 1, wherein each fully active spring and the associated pocket are dimensioned such that, when the fully active spring is enclosed in the associated pocket, the first and second end turns are compressed such that the compressed first end turn lies in a first plane arranged at an angle different from 90° relative to the spring axis and the compressed second end turn lies in a second plane arranged at an angle different from 90° relative to the spring axis.

4. The method of claim 1, wherein each fully active spring further includes a first end extension which extends from the first end turn and bends toward the central spiral portion, and a second end extension which extends from the second end turn and bends toward the central spiral portion.

5. The method of claim 1, wherein each fully active spring has a wire gauge selected from an interval from at least 0.8 mm to at most 2.2 mm.

6. The method of claim 1, wherein the central spiral portion of each fully active spring has a diameter selected from an interval from at least 25 mm to at most 90 mm.

7. A pocket spring core for a bedding or seating cushion, said pocket spring core comprising;

an array of pocket springs, said array of pocket springs comprising fully active springs respectively enclosed in an associate pocket of fabric, each fully active spring respectively being made of only one piece of wire and having a central spiral portion with at least one turn and defining a spring axis, and an unknotted second end turn defining an opposing second end of the fully active spring, wherein each fully active spring has a rest shape in which the first end turn and the second end turn have a finite pitch angle which is greater than the pitch angle when the fully active spring is enclosed in an associated pocket, so that the first end turn and the second end turn contribute to a spring force of the fully active spring.

8. The pocket spring core of claim 7, wherein for each fully active spring, the rest shape of the fully active spring is such that the first end turn has a pitch angle of at least 8° at any location on the first end turn within 35 mm from an upper spring end, and the second end turn has a pitch angle of at least 8° at any location on the second end turn within 35 mm from a lower spring end.

9. The pocket spring core of claim 7, wherein each fully active spring and the associated pocket are dimensioned such that, when the fully active spring is enclosed in its associated pocket, the first and second end turns are compressed such that the compressed first end turn lies in a first plane arranged at an angle different from 90° relative to the spring axis and the compressed second end turn lies in a second plane arranged at an angle different from 90° relative to the spring axis.

10. The pocket spring core of claim 7, wherein each fully active spring further includes:

a first end extension which extends from the first end turn and bends toward the central spiral portion, and a second end extension which extends from the second end turn and bends toward the central spiral portion.

11. The pocket spring core of claim 7, wherein each fully active spring has a wire gauge selected from an interval from at least 0.8 mm to at most 2.2 mm.

12. The pocket spring core of claim 7, wherein the central spiral portion of each fully active spring a diameter selected from an interval from at least 25 mm to at most 90 mm.

13. A fully active spring for a pocket spring core for a bedding or seating cushion, said fully active spring having:

a central spiral portion with at least one turn, an unknotted first end turn defining a first end of the fully active spring, and an unknotted second end turn defining a second end of the fully active spring arranged opposite to the first end, said fully active spring being made of a single piece of wire and having a rest shape in which the first end turn and the second end turn have a finite pitch angle which is greater than the pitch angle when the fully active spring is enclosed in an associated pocket, so that the first end turn and the second end turn contribute to a spring force of the fully active spring.

14. The fully active spring of claim 13, wherein the first end turn has a pitch angle of at least 8° at any location on the first end turn within 35 mm from an upper spring end, and the second end turn has a pitch angle of at least 8° at any location on the second end turn within 35 mm from a lower spring end.

15. The fully active spring of claim 13, wherein the fully active spring has a wire gauge selected from an interval from at least 0.8 mm to at most 2.2 mm, and wherein the central spiral portion has a diameter selected from an interval from at least 25 mm to at most 90 mm.

* * * * *